US005503281A

United States Patent [19]

Bergner et al.

[11] Patent Number: 5,503,281

[45] **Date of Patent: * Apr. 2, 1996**

[54] PACK FOR POURABLE PRODUCTS

[75] Inventors: Rainer Bergner, Duesseldorf; Hubert Droessler, Erkrath; Siegfried Konkel, Duesseldorf; Volker Weiss, Langenfeld; Paul-Otto Weltgen, Hilden, all of Germany

[73] Assignee: Henkel Kommanditgesellschaft auf Aktien, Duesseldorf, Germany

[ * ] Notice: The portion of the term of this patent subsequent to Jun. 21, 2011, has been disclaimed.

[21] Appl. No.: 157,166

[22] PCT Filed: May 26, 1992

[86] PCT No.: PCT/EP92/01180

§ 371 Date: Dec. 6, 1993

§ 102(e) Date: Dec. 6, 1993

[87] PCT Pub. No.: WO92/21578

PCT Pub. Date: Dec. 10, 1992

[30] Foreign Application Priority Data

Jun. 4, 1991 [DE] Germany ..... 41 18 252.9

[51] Int. Cl.[6] ..... B65D 23/08

[52] U.S. Cl. ..... 215/12.1; 215/395; 229/89

[58] Field of Search ..... 229/89, 23 BT; 215/12.1, 12.2, 100 R, 395, 396; 220/770, 771, 756

[56] References Cited

U.S. PATENT DOCUMENTS

| | | | |
|---|---|---|---|
| 1,985,075 | 12/1934 | Bird | 229/89 |
| 3,160,326 | 12/1964 | Sturdevant et al. | 215/12.1 X |
| 3,521,810 | 7/1970 | Boyer | 229/23 BT |
| 4,278,167 | 7/1981 | Van Rossem | 215/12.1 X |
| 4,392,605 | 7/1983 | Backman | 229/23 BT X |
| 4,589,560 | 5/1986 | Harris, Jr. | 215/12.1 X |
| 4,782,945 | 11/1988 | Geiler et al. | 215/12.1 X |
| 5,299,700 | 4/1994 | Beniacar | 215/12.1 |
| 5,322,184 | 6/1994 | Bergner et al. | 220/739 X |
| 5,351,851 | 10/1994 | Powell | 229/89 X |

FOREIGN PATENT DOCUMENTS

| | | | |
|---|---|---|---|
| 0406625 | 1/1991 | European Pat. Off. . | |
| 2068063 | 7/1971 | France | 229/89 |
| 0932899 | 9/1955 | Germany . | |
| 3921258 | 1/1991 | Germany . | |
| 412609 | 7/1934 | United Kingdom | 229/89 |

*Primary Examiner*—Allan N. Shoap
*Assistant Examiner*—Christopher J. McDonald
*Attorney, Agent, or Firm*—Ernest G. Szoke; Wayne C. Jaeschke; Kenneth Watov

[57] ABSTRACT

A package for flowable goods includes an inner thin-walled plastic body for receiving pourable goods. The inner plastic body has a rectangular cross section, and is surrounded by a supporting envelope having an open top and bottom, and an upper stacking edge for resting on the plastic hollow body in the packaging position. A depression is formed in at least one corner of the inner body for receiving a tongue of the supporting envelope, whereby the tongue is cut out transversely to the corner depression, and hinged via two lateral edges for permitting the tongue to be folded into the depression.

8 Claims, 3 Drawing Sheets

PACK FOR POURABLE PRODUCTS

RELATED APPLICATION

This application is related to Ser. No. 893,598, filed Jun. 2, 1992, for "Package for Pourable Substances", now U.S. Pat. No. 5,322,184 issued Jun. 21, 1994, and having a common assignee herewith.

BACKGROUND

1. Field of the Invention

The field of the present invention relates generally to packs for pourable products, and more particularly to such packs that consist of an inner container surrounded by a separable supporting jacket.

2. Discussion of Related Art

This invention relates to a pack for pourable products, such as liquids or free-flowing fine granules or the like, which consists of an inner thin-walled blown plastic container, preferably of substantially rectangular cross-section, intended to hold the product and of a base- and cover-free supporting jacket—preferably with an upper supporting edge—surrounding the blown plastic container and bearing against it in the in-use position of the pack, the blown plastic container preferably being provided with an upper bearing shoulder for resting on the supporting edge of the supporting jacket and comprising at least one recess at a distance from its base and shoulder. The supporting jacket is provided with at least one lap designed to fold over inwards into the recess as a fixing element for the supporting jacket.

One such pack is known from applicants' DE-A-39 21 258. In this known pack, the blown plastic container, which has very thin walls by comparison with conventional plastic bottles, can be made by blow moulding from a blow-mouldable plastic so that the plastic content of the pack can be kept very small. Strength and stability are provided by the supporting jacket while the connection between the supporting jacket and the blown plastic container is established by an upper supporting edge of the jacket, on which the bearing shoulder of the blown plastic container rests, and by a lap designed to fold into the recess.

This known pack is evironmentally friendly by virtue of its small plastic and cardboard contents and can be separately disposed of by the user after use by virtue of its relatively simple two-piece construction (blown plastic container and supporting jacket). In particular, the supporting jacket can be recycled as wastepaper. However, this known pack has the disadvantage that its two parts, namely the blown plastic container and the supporting jacket, are still not satisfactorily fixed, particularly when the pack is full and thus heavy. The laps are foldably connected to the supporting jacket on one side only and have a score line extending longitudinally of the supporting jacket. This gives rise to the danger, particularly in known packs without any detent elements to hold the laps, that the laps spring back because of the resilience of their constituent material so that, when the pack is picked up, the blown plastic container slides out from the supporting jacket. In addition, the design of the handles is not optimal.

DE-A-93 28 99 describes a base- and cover-free cardboard jacket of rectangular cross-section as a pack for electric light bulbs. At each corner, this jacket comprises two laps folded inwards. The laps are arranged in such a way that they bear on top and underneath against the glass of an electric light bulb accommodated in the pack. This known jacket does not cooperate with another part of the pack on which it is to be held.

SUMMARY OF THE INVENTION

The object of the present invention is to provide a solution by which the handling properties of packs of the type mentioned above, more particularly the connection between the blown plastic container and the supporting jacket, are both improved, and would enable the plastic and cardboard contents of the pack to be minimized.

In a pack of the type mentioned above, the solution provided by the invention is characterized in that at least one recess is provided at only one corner or at two opposite corners, a lap foldably connected to the supporting jacket along two side edges and cut transversely of the corner being folded into said recess.

This construction considerably improves the handling properties of a pack of the type in question without increasing the plastic and cardboard contents of the pack, i.e. the pack is also environmentally friendly. Even one recess at one corner of the blown plastic container with a lap folded therein is sufficient to hold the supporting jacket on the blown plastic container. Because the lap is foldably connected to the supporting jacket along two side edges and is cut transversely of the corner, it has two sides and projects with both sides into the recess, bearing against the wall thereof. There is no longer any danger of the lap springing back through the resilience of its constituent material. When recesses are provided at two opposite corners, they may also serve as gripping aids.

In one particular embodiment of the invention, the blown plastic container comprises a substantially square recess at each of two diagonally opposite corners, a folding lap being associated with each recess. This construction and arrangement of the recesses with the associated laps of the supporting jacket provides a particularly user-friendly handle adapted to the hand of the user. Besides satisfactorily fixing the supporting jacket on the blown plastic container, these recesses form an optimal gripping aid. Square recesses have proved to be particularly advantageous for fixing the laps.

In one advantageous embodiment of the invention, grip holes are formed in the folding laps. This construction has the advantage that, for subsequent separate disposal of the container, the jacket can easily be stripped off by virtue of the fact that the laps can readily be withdrawn beforehand from the associated recesses.

To establish an even safer connection between the blown plastic container and the surrounding supporting jacket, which is desirable in particular for relatively large packs or packs with heavy contents, the invention also provides for an additional connection between the supporting jacket and the blown plastic container so that two recesses each with an associated lap of the supporting jacket are formed in one corner of the blown plastic container. This additional connection has the advantage that the supporting jacket can be prevented from slipping or sliding off the blown plastic container in both directions, which is helpful in particular with recesses and laps of substantially triangular cross-section.

BRIEF DESCRIPTION OF THE DRAWINGS

The invention is described in more detail in the following with reference to the accompanying drawings, in which similar items are identified by the same reference designation, wherein.

DETAILED DESCRIPTION OF THE INVENTION

In the illustrated example of the invention, the pack globally denoted by the reference 1 consists of a blown plastic container 2 of substantially square cross-section and a supporting jacket 3 of cardboard or similar material.

Figure 1:
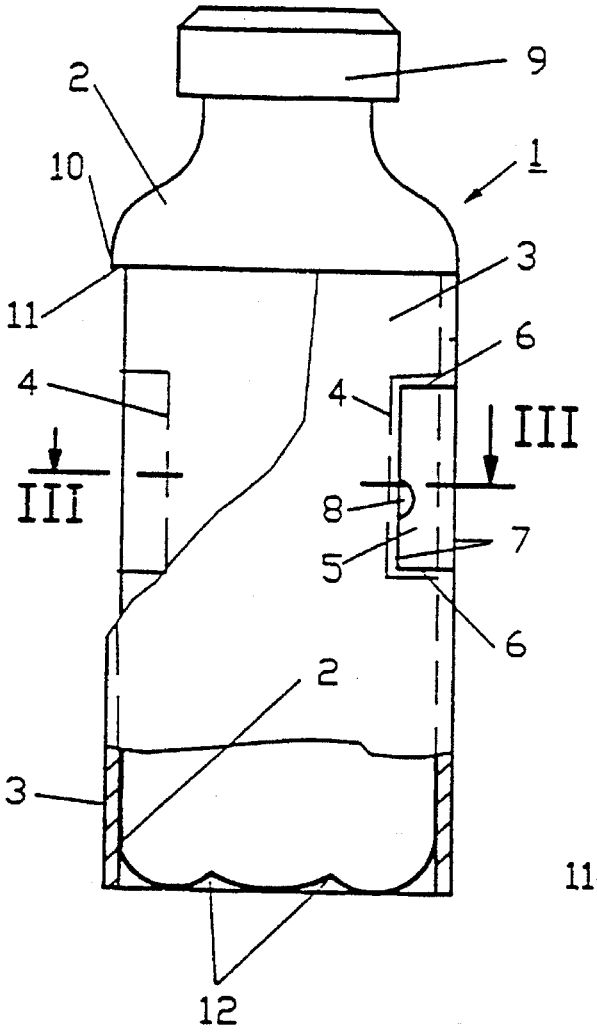
FIG. 1 is a side elevational of a pack with the jacket partly broken away.
Figure 3:
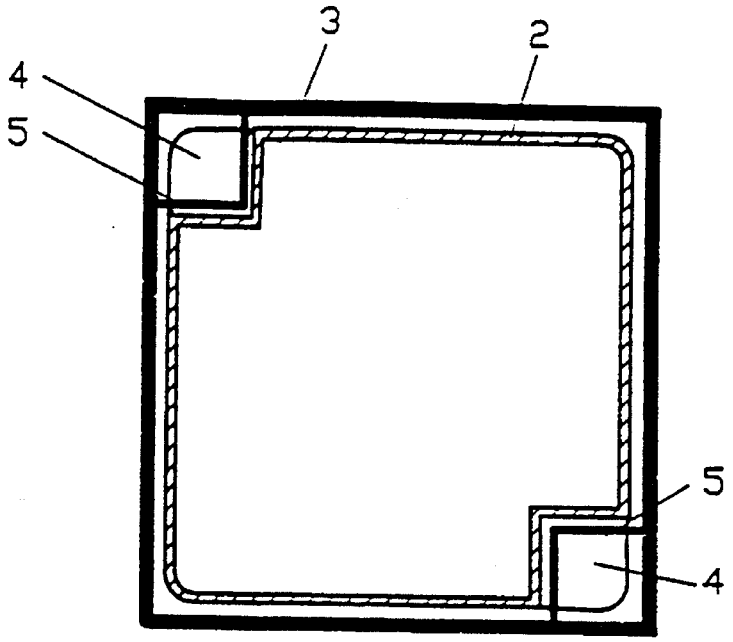
FIG. 3 is a section taken along the line III—III in FIG. 1.
Figure 4:
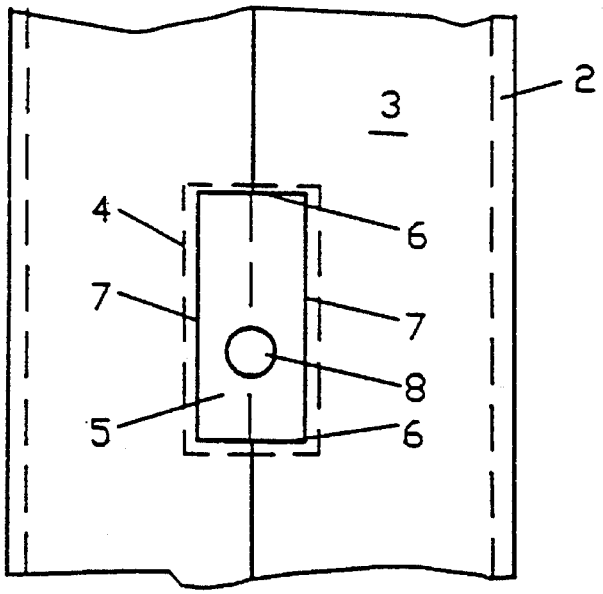
FIG. 4 shows part of a box blank for the supporting jacket of the pack.

At each of two opposite corners of the blown plastic container 2, the pack 1 shown in FIGS. 1 and 3 is provided with a recess 4 which is shown in chain lines in FIG. 1 and which is substantially square or rectangular in shape. The recesses 4 serve as handles in which the laps 5 of the supporting jacket 3 engage. The laps 5 are formed by cutouts 6 and scored folding lines 7 at the corresponding corners of the supporting jacket 3. In addition, each lap 5 has a grip hole 8 which is suitably punched out, and which facilitates withdrawal of the lap 5 from the particular recess 4.

Shown in the upper region of the blown plastic container 2 are a closure cap 9 and an upper bearing shoulder 10 which, in the in-use position, rests on the free edge 11 of the surrounding supporting jacket 3. The blown plastic container 2 has a multiple-curve base to increase its stability, as indicated by the reference 12.

To strengthen the connection between the blown plastic container 2 and the supporting jacket 3 surrounding it, another, but smaller square recess 13 is provided at the lower end of the blown plastic container 2 (FIG. 2), an associated, partly cutout lap 14 of the supporting jacket 3 being designed to fold into the recess 13. The mode of operation and design of the fixing system 13, 14 corresponds to that formed by the laps 5 and recesses 4, the grip hole 8 being optional.

The construction of the handles in accordance with the invention with the suitably shaped recesses 4 and associated laps 5 provides overall for particularly easy handling of the pack 1. The handles (recesses 4, laps 5) form suitable grips for the hand of a user, enabling the pack to be safely handled, and also establish a safe connection between the two parts 2, 3 of the pack, the connection thus established being further strengthened by the additional fixing system 13, 14. The special design of the laps 5 with the grip hole 8 provides for easy separation of the two parts 2, 3 of the pack, so thereby encourgages the user to dispose of the two parts separately, and making the supporting jacket in particular recyclable as wastepaper.

The supporting jacket 3 may also have a multilayer construction should this be necessary for stability reasons.

Figure 2:
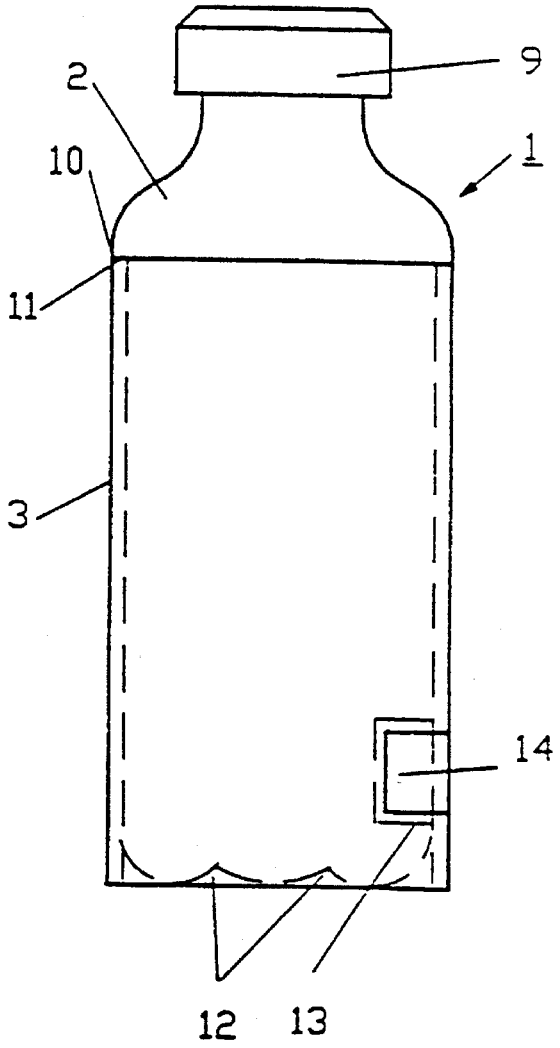
FIG. 2 is a side elevational of a pack with an additional fixing element.
Figure 5:
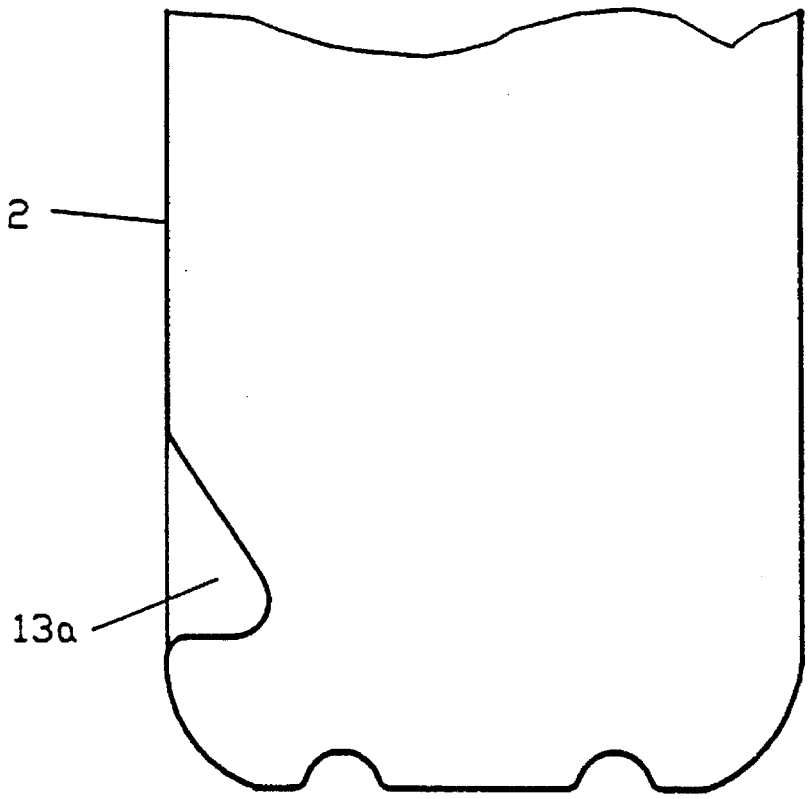
FIG. 5 shows a triangular recess in a blown plastic container illustrated in a lower portion thereof only.
Figure 6:
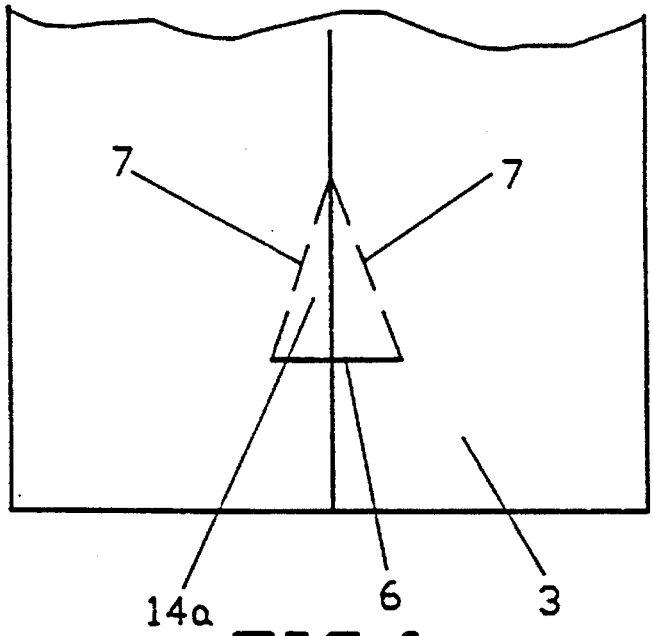
FIG. 6 shows part of a box blank for the blown plastic container illustrated in FIG. 5.

In addition, the fixing system 13,14 may also be used for packs with no handles (recesses 4), serving as a sole connecting element between the blown plastic container 2 and the supporting jacket 3, as shown in FIG. 2. In this example, the lap may also be triangular in shape, as shown in FIG. 6 (lap 14*a*). The lap 14*a* is defined by a punched line 6 and two score lines 7 in the supporting jacket 3. The lap 14*a* may cooperate with a recess 13*a* of triangular cross-section in the blown plastic container 2 (FIG. 5), although this is not essential. In addition, only two fixing systems 13, 14 or 13*a*, 14*a* or 13, 14*a* may be arranged at one corner of the blown plastic container of a pack 1 without handles (recesses 4, laps 5) being formed. The laps 5, 14 and 14*a* are foldably connected to the supporting jacket 3 via score lines 7 which form their side edges and comprise at least one cutout or punched line 6 cut transversely of the corner. Although various embodiments of the invention have been shown and described above, they are not meant to be limiting. Those of skill in the art may recognize certain modifications to the illustrated embodiments of the invention, which modifications are meant to be covered by the spirit and scope of the appended claims.

What is claimed is:

1. A pack for pourable products, comprising an inner thin-walled blown plastic container of substantially rectangular cross-section, intended to hold the product and of a base-and cover-free supporting jacket—with an upper supporting edge—surrounding the blown plastic container and bearing against it in the in-use position of the pack, the blown plastic container being provided with an upper bearing shoulder for resting on the supporting edge of the supporting jacket, and comprising at least one recess at a distance from its base and shoulder and the supporting jacket being provided with at least one lap designed to fold over inwards into the recess as a fixing element for the support jacket, characterized in that at least one recess is provided at one corner, a lap foldably connected to the supporting jacket along two side edges and cut transversely of the corner being folded into said recess.

2. A pack as claimed in claim 1, wherein the blown plastic container further includes a substantially square recess at each of two diagonally opposite corners, a folding lap being associated with each recess.

3. A pack as claimed in claim 2, further includes grip holes formed in each of the folding laps.

4. A pack as claimed in claim 1, further including two recesses each with an associated lap, respectively, of the supporting jacket formed in one corner of the blown plastic container.

5. A pack as claimed in claim 2, further including two recesses with an associated lap for each recess, respectively, of the supporting jacket formed in one corner of the blown plastic container.

6. A pack as claimed in claim 3, further including two recesses with an associated lap for each recess, respectively, of the supporting jacket formed in one corner of the blown plastic container.

7. A pack as claimed in claim 4, further including a grip hole being formed in the associated lap located closest to the supporting edge of said jacket.

8. A pack as claimed in claim 5, further including grip holes formed in the associated laps located closest to the supporting edge of said jacket.

* * * * *

UNITED STATES PATENT AND TRADEMARK OFFICE

CERTIFICATE OF CORRECTION

PATENT NO. : 5,503,281
DATED : Apr. 2, 1996
INVENTOR(S) : Bergner et al.

It is certified that error appears in the above-indentified patent and that said Letters Patent is hereby corrected as shown below:

In Col 3, line 1, after "elevational" please insert --view--.
In Col 3, line 3, after "elevational" please insert --view--.

Signed and Sealed this

Seventh Day of April, 1998

Bruce Lehman

*Attest:*

BRUCE LEHMAN

*Attesting Officer*

*Commissioner of Patents and Trademarks*